US006144171A

United States Patent [19]

Clements et al.

[11] Patent Number: 6,144,171

[45] Date of Patent: Nov. 7, 2000

[54] IGNITOR FOR HIGH INTENSITY DISCHARGE LAMPS

[75] Inventors: Neal Clements, Rosemont, Ill.; Oscar Deurloo, Valkenswaard, Netherlands

[73] Assignee: Philips Electronics North America Corporation, New York, N.Y.

[21] Appl. No.: 09/306,911

[22] Filed: May 7, 1999

[51] Int. Cl.[7] ..... H05B 37/00

[52] U.S. Cl. ..... 315/289; 315/291; 315/307; 315/209 R

[58] Field of Search ..... 315/291, 307, 315/224, 274, 276, DIG. 7, 209 R, 209 M, 289, 338, 344, 290, 214

[56] References Cited

U.S. PATENT DOCUMENTS

| | | | |
|---|---|---|---|
| 4,563,616 | 1/1986 | Stevens | 315/220 |
| 5,034,663 | 7/1991 | Cook, II et al. | 315/307 |
| 5,047,694 | 1/1986 | Nuckolls et al. | 315/290 |
| 5,449,980 | 9/1995 | Kiefer | 315/DIG. 5 |
| 5,909,089 | 6/1999 | Deurloo et al. | 315/307 |
| 5,936,359 | 8/1999 | Gibson | 315/244 |
| 6,008,591 | 12/1999 | Huber et al. | 315/224 |

*Primary Examiner*—Don Wong
*Assistant Examiner*—Ephrem Alemu
*Attorney, Agent, or Firm*—Bernard Franzblau

[57] ABSTRACT

An improved high intensity discharge ("HID") ignition circuit for a ballast uses a gapped transformer with a capacitor placed across the secondary thereof. The ballast includes a DC source, a down converter, a commutator, and the ignition circuit. The output of the commutator is supplied to the secondary winding of the gapped transformer and the lamp, which are connected in series. The lamp is an HID lamp such as, for example, a metal halide lamp, high pressure sodium lamp, high pressure mercury lamp, or a metal vapor lamp. Power is furnished to the lamp over a cable. Ignition of the lamp is handled by the ignition circuit, which in addition to the secondary winding and the capacitor includes an inductor, the primary winding of the gapped transformer, two SIDACs, and the parallel combination of a resistor and a capacitor, all connected in series between the output of the down converter. The design parameters of the gapped transformer are selected so that the gapped transformer does not saturate at full load current. The capacitor across the secondary of the gapped transformer adjusts the resonance frequency of the secondary circuit for shaping the ignition pulse so that the ignition pulse specification of the HID lamp is met throughout the full range of load conditions for which the ballast is intended, including varying load capacitance as affected by length of the cable.

18 Claims, 5 Drawing Sheets

IGNITOR FOR HIGH INTENSITY DISCHARGE LAMPS

BACKGROUND OF THE INVENTION

The present invention relates generally to circuits useful in the operation of high intensity discharge lamps, and more particularly to ignition circuits for high intensity discharge lamps.

High intensity discharge ("HID") lamps such as, for example, metal halide, high pressure sodium, high pressure mercury, and metal vapor require ignition before they are able to operate in their "arc" stages and furnish their rated illumination. Ignition of an HID lamp requires the application of a high voltage pulse, typically a few thousand volts, across the terminals of the lamp. Ignition and lamp operation is performed by circuits known as "ballasts."

FIG. 1 shows a ballast circuit 10 which is useful for igniting and operating an HID lamp 38. Direct current ("DC") voltage is generated by DC source 12, suitable designs for which are well known in the art. The voltage from the DC source 12 is supplied to a down converter 14, which functions as a current source with reduced voltage relative to the output of the DC source 12. Suitable designs for the down converter 14 are well known in the art. The output of the down converter 14 is supplied to a commutator 16, suitable designs for which are well known in the art. The output of the commutator 16 applies a periodically reversing current flow to a secondary winding 34 of a transformer 30 and the lamp 38, which are connected in series. Power is furnished to the lamp 38 over cable 36, the length of which typically ranges from a foot or so to fifteen feet.

Ignition of the lamp 38 is handled by the ignition circuit 20. In addition to the secondary winding 34, the ignition circuit 20 includes inductor 22, the primary winding 32 of the transformer 30, two SIDACs 24 and 26, and the parallel combination of resistor 28 and capacitor 29, all connected in series between the output of the down converter 14.

The ignition circuit 20 operates as follows to ignite the lamp 38. A capacitor (not shown) at the output of the down converter 14 charges based on the switching frequency and duty cycle of a transistor switch (not shown) in the down converter 14. The voltage across the SIDACs 24 and 26 is equal to the voltage across the capacitor at the output of the down converter 14 until the breakover of the SIDACs 24 and 26 occurs, at which time a voltage pulse is applied to the primary winding 32 and coupled to the secondary winding 34 as a high voltage pulse. To ensure good coupling between the primary winding 32 and the secondary winding 34 so that a good ignition pulse is achieved, the core of the transformer 30 is ungapped. The SIDACs 24 and 26 remain ON until the current through them falls below their holding current, when they turn OFF. At this time, capacitor 29 discharges through the resistor 28. Now, if the lamp 38 has ignited, the down converter 14 provides a large current to the lamp 38 through the commutator 16, but the output voltage of the down converter 14 drops below the breakover voltage of the SIDACs 24 and 26 so that the ignition circuit 20 becomes inactive. On the other hand, if the lamp 38 does not ignite, the voltage across the capacitor at the output of the down converter 14 begins to increase until it becomes equal to breakover voltage of the SIDACs 24 and 26 and the ignition cycle repeats. The inductor 22 limits di/dt to protect the SIDACs 24 and 26.

Suitable values for the various components of the ignition circuit 20 designed for driving a 100W ceramic metal halide lamp, for example, are as follows: inductor 22, 47 $\mu$H; SIDAC 24, type MKP1V120 or equivalent; SIDAC 26, type MKP1V120 or equivalent; resistor 28, 10KΩ; and capacitor 29, 220 nF. The transformer 30 is of the ungapped type having a E25/13/11 bobbin with four sections, a 3C85 ferrite core, a wire primary of 9 turns of 0.45 wire, and a wire secondary of 132 turns of 0.45 wire.

SUMMARY OF THE INVENTION

We have found that, unfortunately, the ballast 10 delivers a substantial amount of ripple current to the lamp 38 when the lamp 38 draws a heavy load current. Ripple current is normally produced by down converters, but in circuit 10 the transformer 30 saturates when heavy current to the lamp 38 flows through the secondary winding 34 so that the secondary winding 34 becomes ineffective for reducing the magnitude of the ripple current. This heavy ripple current causes acoustic resonance in the lamp 38, which can extinguish the lamp 38, shorten its lifetime, and cause various lamp maintenance problems.

We have also found that varying the length of the cable 36 used to carry power to the lamp 38 can make lamp ignition unreliable, especially as the cable 36 is lengthened.

A need, therefore, exists for apparatus and methods to reduce the ripple current delivered to the lamp 38 by ballasts generally of the type shown in FIG. 1 while not having the lamp ignition process be unduly sensitive to the length of the cable 36.

Accordingly, an object of the present invention is to provide an HID lamp ignition circuit that helps reduce the ripple current at the lamp 38.

Another object of the present invention is to provide an HID lamp ignition circuit that is not unduly sensitive to length of the cable to the lamp over a practical range of cable lengths.

These and other objects are achieved in the various embodiments of the present invention. For example, one embodiment of the present invention is an ignition circuit for igniting a high intensity discharge lamp having a predetermined ignition pulse specification and a predetermined maximum operating load current drain specification. The ignition circuit comprises a transformer having a primary winding and at least one secondary winding, the transformer being rated to avoid saturating with the maximum operating load current flowing through the secondary winding thereof; a first capacitor coupled in parallel with the secondary winding of the gapped transformer; first and second lamp connection nodes coupled in series with the secondary winding of the gapped transformer; a power switch coupled in series with the primary winding of the gapped transformer; and a second capacitor coupled to the primary winding of the gapped transformer.

Another embodiment of the present invention is an electronic ballast for igniting and operating a high intensity discharge lamp. The ballast comprises a DC power supply; a commutator coupled to the outputs of the DC power supply; a gapped transformer having a primary winding and at least one secondary winding; an ignition secondary circuit comprising the secondary winding of the gapped transformer, a first capacitor coupled in parallel with the secondary winding of the gapped transformer, and first and second lamp connection nodes coupled in series with the secondary winding of the gapped transformer between the outputs of the commutator; and an ignition primary circuit comprising an inductor, the primary of the gapped transformer, a voltage-dependent breakover element; and a second capacitor coupled in series between the outputs of the DC power supply, the ignition primary circuit further having a resistor coupled in parallel with the second capacitor.

Yet another embodiment of the present invention is a method of igniting a high intensity discharge lamp ignition having a predetermined ignition pulse specification and a predetermined maximum operating load current, comprising applying a voltage pulse to a primary winding of a transformer to produce a high voltage pulse on a secondary winding thereof; shaping the high voltage pulse with a first capacitor connected in parallel with the secondary winding of the transformer to create an ignition pulse in compliance with the predetermined ignition pulse specification of the high intensity discharge lamp; applying the ignition pulse to the high intensity discharge lamp to start the lamp; and furnishing the predetermined maximum operating load current to the lamp through the secondary winding of the transformer without causing the transformer to saturate.

DETAILED DESCRIPTION OF THE INVENTION

Figure 2:
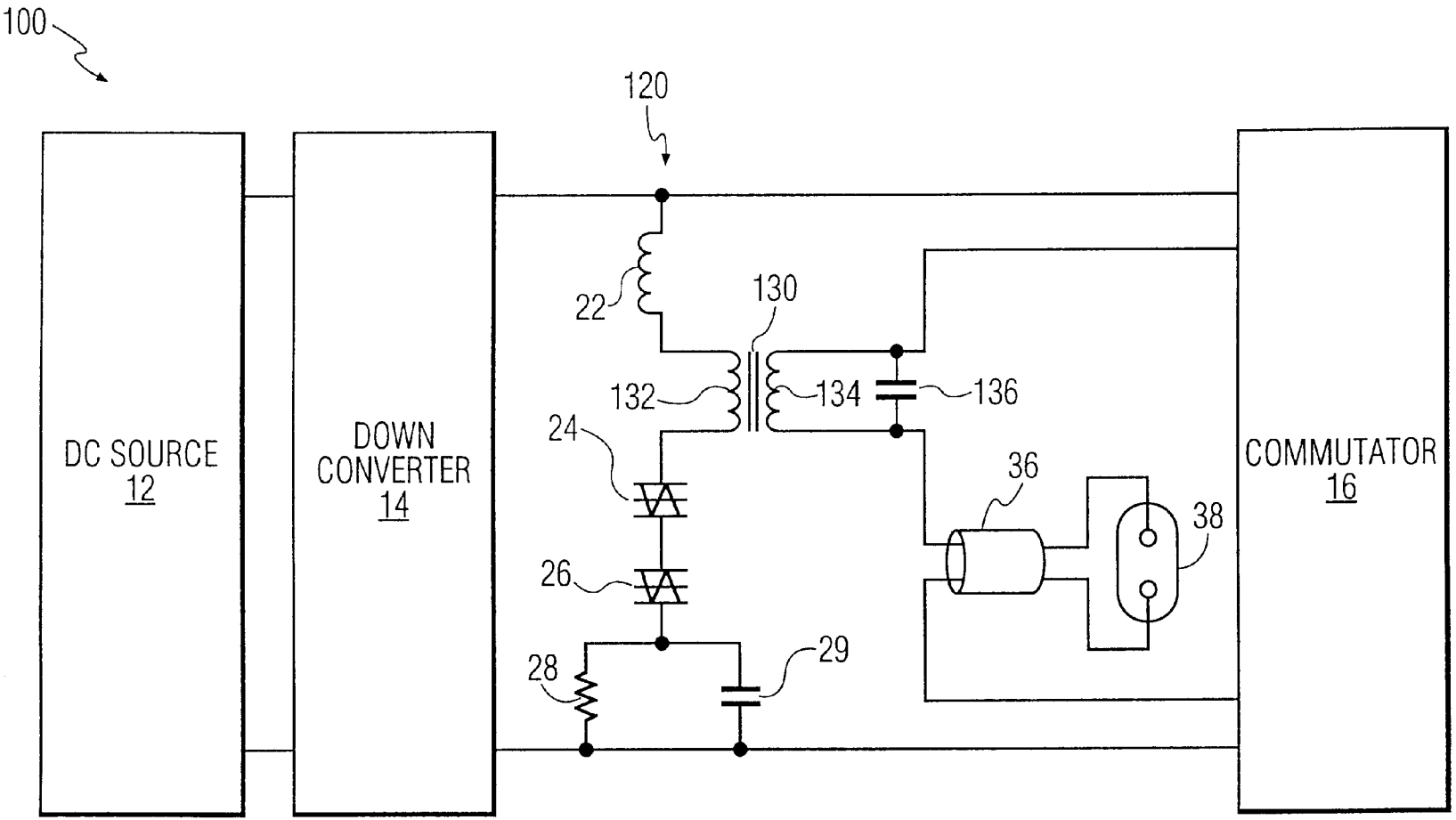
FIG. 2 is a schematic circuit diagram of an improved ignition circuit in accordance with the present invention, which is incorporated into the ballast of FIG. 1 to improve the overall performance thereof.

A ballast 100 having an improved HID ignition circuit 120 is shown in FIG. 2. The ballast 100 is similar to the ballast 10 except that the transformer 130 is a gapped transformer and a capacitor 136 is placed across a secondary winding 134 of the gapped transformer 130. Specifically, direct current ("DC") voltage is generated by DC source 12, the voltage from the DC source 12 is supplied to a down converter 14, the output of the down converter 14 is supplied to the commutator 16, and the output of the commutator 16 is supplied to the secondary winding 134 of the gapped transformer 130 and the lamp 38, which are connected in series. Power is furnished to the lamp 38 over cable 36. The lamp 38 is a high intensity discharge ("HID") lamp such as, for example, a metal halide lamp, high pressure sodium lamp, high pressure mercury lamp, or a metal vapor lamp. Ignition of the lamp 38 is handled by the ignition circuit 120, which in addition to the secondary winding 134 and the capacitor 136 includes inductor 22, the primary winding 132 of the gapped transformer 130, two SIDACs 24 and 26, and the parallel combination of resistor 28 and capacitor 29, all connected in series between the output of the down converter 14.

The design parameters of the gapped transformer 130 are selected so that the gapped transformer 130 does not saturate at full load current. As a result, the secondary winding 134 retains sufficient inductance even at full load current to attenuate the ripple current delivered by the down converter 14. Advantageously, the secondary winding 134 is effective in attenuating ripple current produced by the down converter 14 throughout the full range of load current delivered to the lamp 38. Since ripple current causes acoustic resonance in the lamp 38, which can extinguish the lamp 38, shorten its lifetime, and cause various lamp maintenance problems, attenuation of the ripple current is desirable. It will be appreciated that, generally speaking, transformers that do not saturate at full load current may be used in place of the gapped transformer 130.

Figure 1:
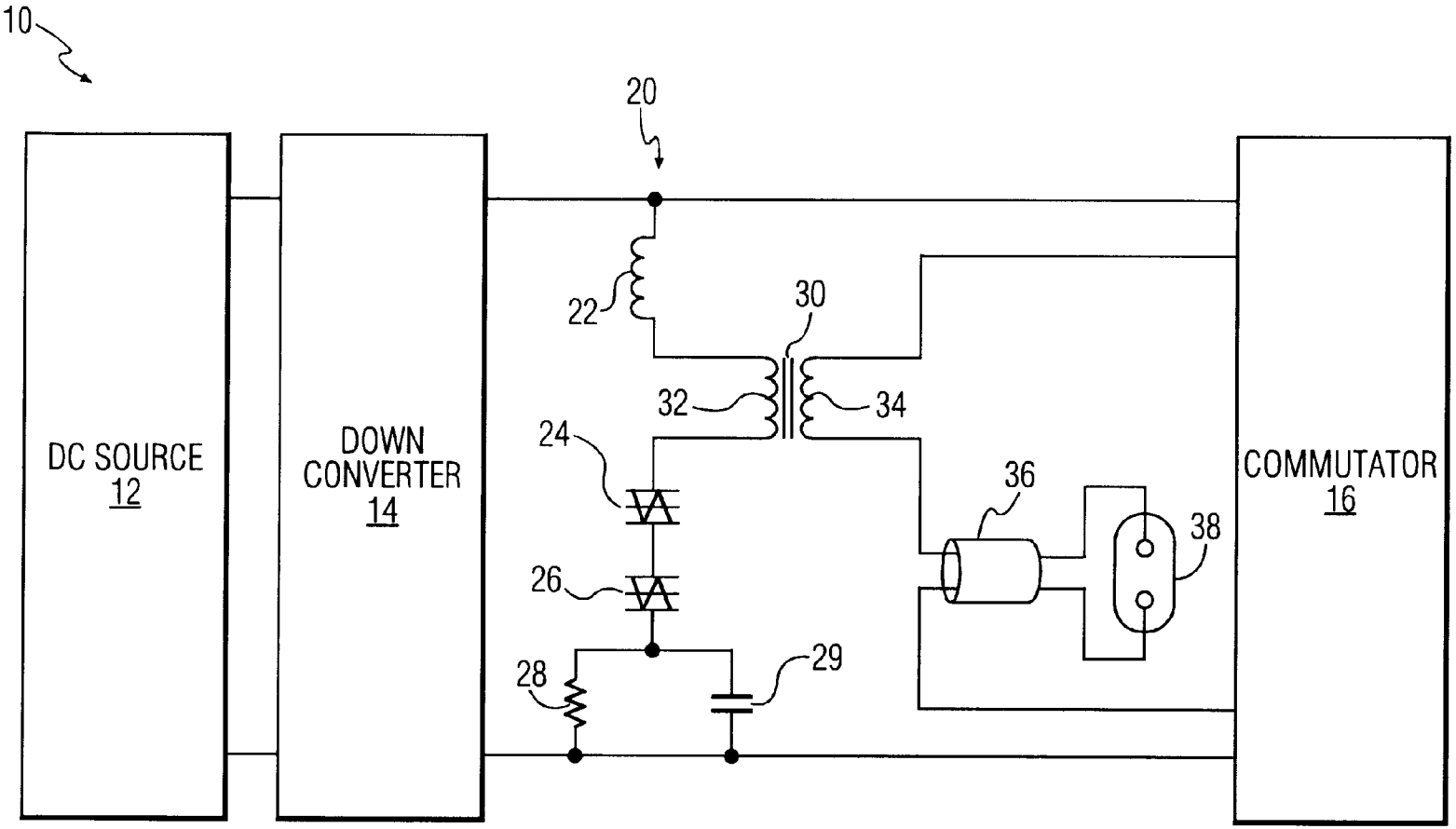
FIG. 1 PRIOR ART
FIG. 1 is a schematic circuit diagram of a ballast found to deliver a high ripple current to a lamp.

Except for the effects of the gapped transformer 130, the ignition circuit 120 operates in substantially the same manner as the ignition circuit 20 of FIG. 1. Specifically, the voltage across the SIDACs 24 and 26 is equal to the voltage across a capacitor at the output of the down converter 14 until the breakover of the SIDACs 24 and 26 occurs, at which time a voltage pulse is applied to the primary winding 132 and coupled to the secondary winding 134 as a high voltage pulse. The SIDACs 24 and 26 remain ON until the current through them falls below their holding current, in which event they turn OFF. At this time, capacitor 29 discharges through the resistor 28. Now, if the lamp 38 has ignited, the down converter provides a large current to the lamp 38 through the commutator 16, but the output voltage of the down converter 14 drops below the breakover voltage of the SIDACs 24 and 26 so that the ignition circuit 120 becomes inactive. On the other hand, if the lamp 38 does not ignite, the voltage across the capacitor at the output of the down converter 14 begins to increase until it becomes equal to breakover voltage of the SIDACs 24 and 26 and the ignition cycle repeats. The inductor 22 limits di/dt to protect the SIDACs 24 and 26.

Since the gapped transformer 130 less effectively couples the pulse from the primary side to the secondary side of the ignition circuit 120, a capacitor 136 is connected across the secondary winding 134. The capacitor 136 adjusts the resonance frequency of the secondary circuit of the transformer 130 for shaping the ignition pulse so that the ignition pulse specification of the lamp 38 is met throughout the full range of load conditions for which the ballast 100 is intended, including varying load capacitance as affected by length of the cable 36. Advantageously, the capacitor 136 promotes reliable lamp ignition. The value of the capacitor 136 is selected both to shape the ignition pulse to the lamp 38 as well as to somewhat stabilize the total capacitance seen by the ignition circuit 120. Preferably, the value of the capacitor 136 is greater than the sum of all other capacitance in the load circuit, including the capacitance of the cable 36 as well as the capacitance inherent in the secondary winding 134.

Suitable values for the various components of the ignition circuit 120 designed for driving a type M90 100W ceramic metal halide lamp are as follows: inductor 22, 47 $\mu$H; SIDAC 24, type MKP1V120 or equivalent; SIDAC 26, type MKP1V120 or equivalent; resistor 28, 10KΩ; and capacitor 29, 220 nF. The transformer 130 is a gapped type having a E25/13/11 bobbin with four sections, a 3C85 ferrite core, a wire primary of 9 turns of 0.45 wire, a wire secondary of 132 turns of 0.45 wire, and a total airgap of 0.6 mm, which is realized preferably by providing two 0.3 mm airgaps in a manner well known in the art. Preferably the number of turns in the secondary winding 134 is kept as low as practical to avoid creating too much resistance in the secondary winding 134. Given these values, the natural resonance frequency of the primary circuit of the transformer 130 is about 43 kHz, the natural resonance frequency of the secondary circuit of the transformer 130 is about 200 kHz, and the coupling coefficient is on the order of about 0.6 to about 0.7. The gap size of the transformer 130 may be varied to achieve a desired amount of inductance in the secondary winding 134 at full range current, provided the ignition pulse coupled to the secondary winding is capable of being shaped by the capacitor 136 to meet the ignition pulse specification of the lamp 38.

It will be appreciated that the higher inductance of the secondary winding 134 at full load current may require adjustments in a manner well known in the art to the control dynamics of the ballast 100. These adjustments are quite dependent on the particular designs used for the DC source 12, the down converter 14, and the commutator 16, in a manner well known in the art.

It will also be appreciated that the values given for the various components of the ballast 100 as well as the design of the gapped transformer 130 are merely illustrative, and that other values and designs are also suitable based on the particular criteria and preferences of the circuit designer. Additionally, a variety of other types of components and circuits may be substituted for the particular components used in the ignition circuit 120 while preserving the basic functionality of the ignition circuit 120. For example, a variety of other power switches such as power MOSFETs and IGBTs may be used instead of the SIDACs 24 and 26 to create a pulse in the primary circuit of the transformer 130. Such power switches, which preferably but not necessarily have a breakover characteristic, are well known to those skilled in the art.

Figure 3:
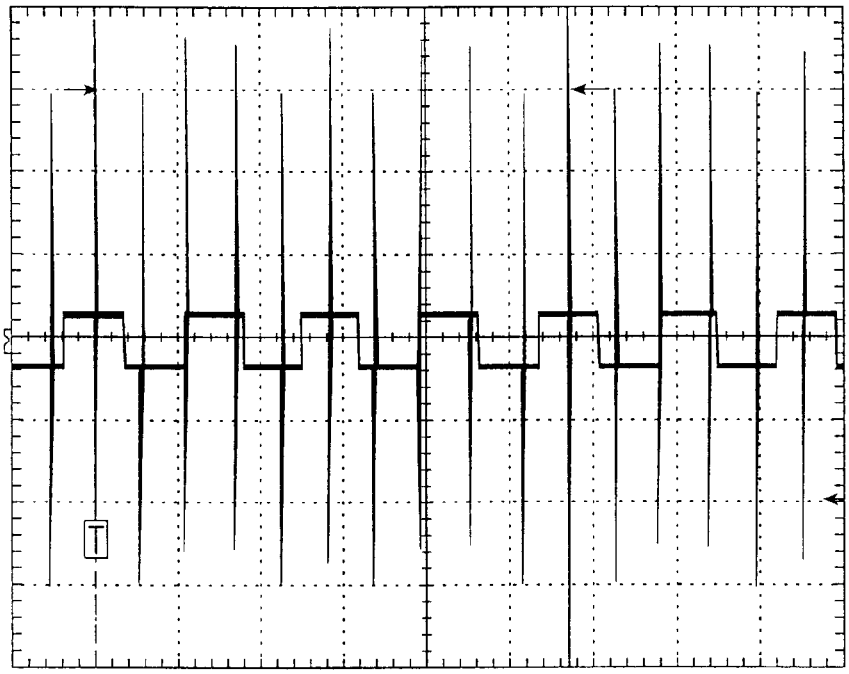
FIG. 3 is a waveform diagram showing the voltage across a cold lamp (open circuit) during operation of the ignition circuit of FIG. 2.

The operation of the ballast 100 with an open lamp load, which essentially represents operation into a cold lamp prior to its entering into a glow stage, is shown in FIG. 3. The y-axis is the open circuit voltage ("OCV") in 1.00 kV major increments, while time is shown along the x-axis in 5.00 ms major increments. The waveform shows normal performance of the ballast 100 in that voltage is applied as a repeating square wave of approximately 150 Hz with at least one ignition pulse per each half cycle. The maximum observed ignition pulse voltage is 3.82 kV. The minimum observed ignition pulse voltage is −2.94 kV. At the time scale shown in FIG. 3, the details of the ignition pulses cannot be observable.

Figure 4:
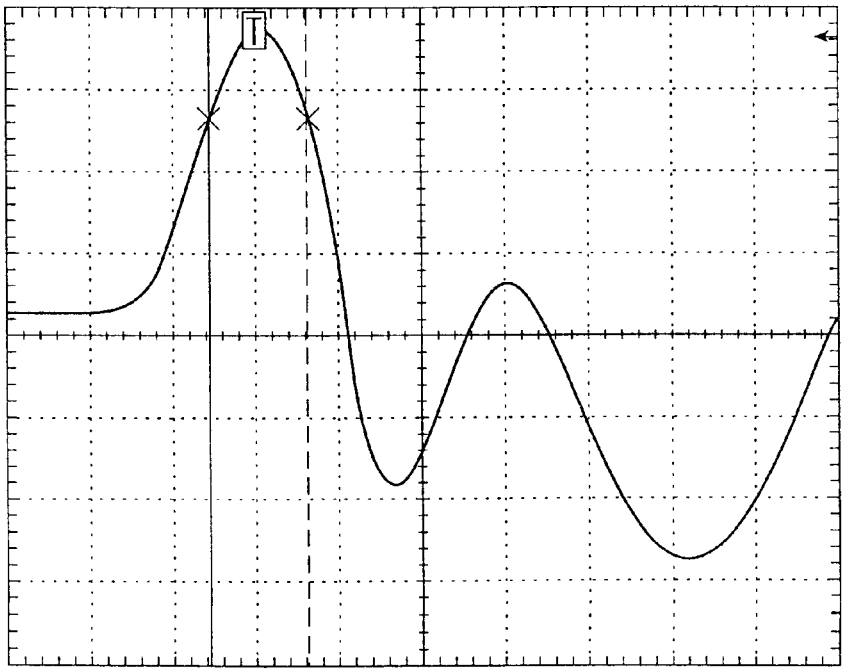
FIG. 4 is a waveform diagram showing an ignition pulse during operation of the ignition circuit of FIG. 2 into a 3 pF load.
Figure 5:
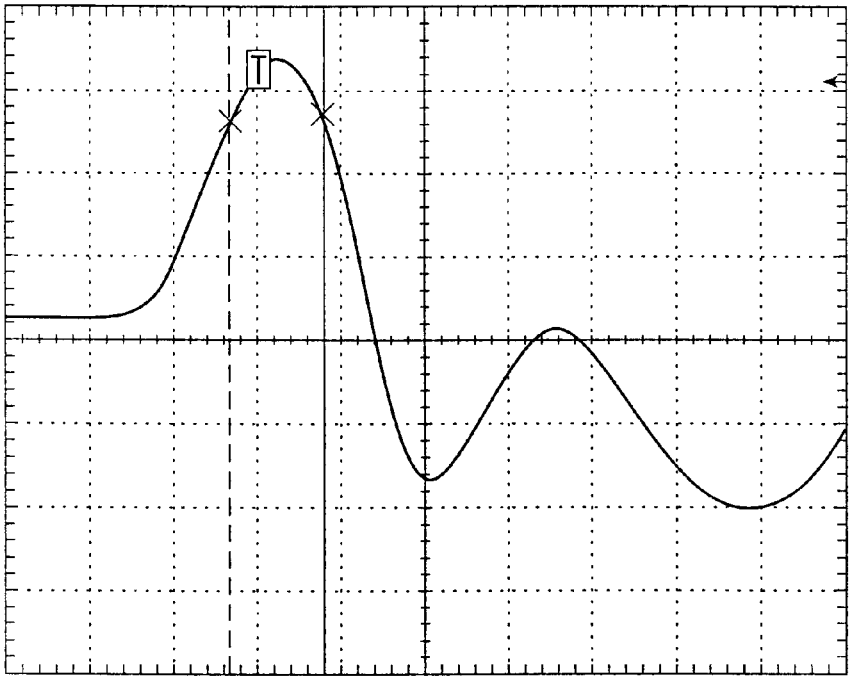
FIG. 5 is a waveform diagram showing an ignition pulse during operation of the ignition circuit of FIG. 2 into a 100 pF load.
Figure 6:
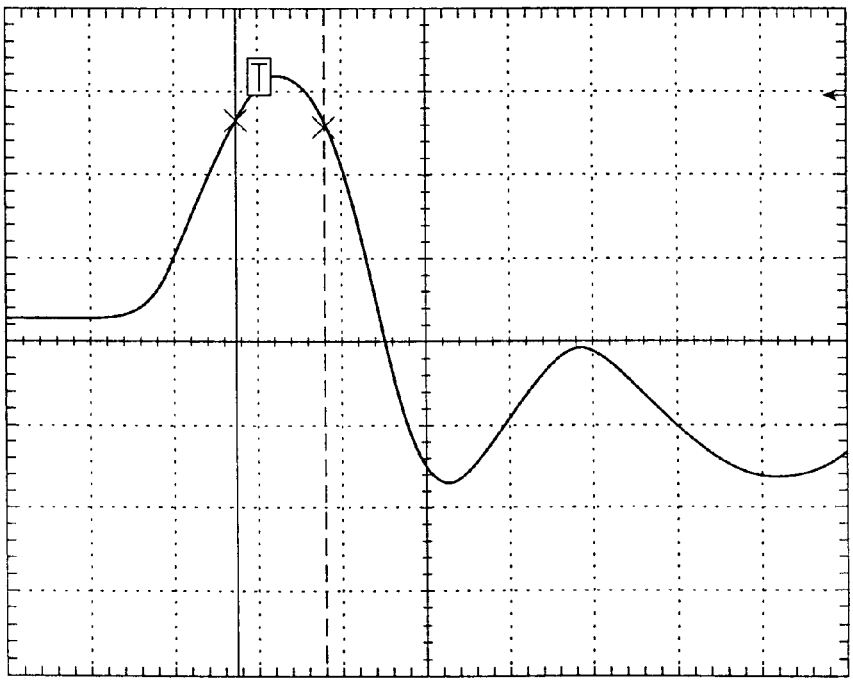
FIG. 6 is a waveform diagram showing an ignition pulse during operation of the ignition circuit of FIG. 2 into a 150 pF load.

The shape of the ignition pulses for capacitive loads of 3 pF, 100 pF and 150 pF are respectively shown in FIGS. 4, 5 and 6. A 3 pF capacitive load is essentially an open circuit, while a 100 pF capacitive load is typical of a ten foot cable to the lamp 38 and a 150 pF capacitive load is typical of a fifteen foot cable to the lamp 38. In these figures, the y-axis is the open circuit voltage ("OCV") in 1.00 kV major increments, while time is shown along the x-axis in 1.00 $\mu$s major increments. The ignition pulse for a lamp such as a 100W metal halide lamp typically is specified to have a peak value of between 3.0 kV and 4.0 kV and a width at the 2.7 kV level of at least about 1.0 $\mu$s for all recommended applications. Other types of lamps have different ignition pulse specifications.

As can be seen in FIG. 4, the ignition circuit 120 delivers an ignition pulse that is within specification when the capacitive load is 3 pF. The peak voltage is 3.82 kV and the 2.7 kV width is about 1.2 $\mu$s. Some decrease in the average voltage is observed, but the decrease is not critical.

As can be seen in FIG. 5, the ignition circuit 120 delivers an ignition pulse that is within specification when the capacitive load is 100 pF. The peak voltage is 3.46 kV and the 2.7 kV width is about 1.3 $\mu$s. Some decrease in the average voltage is observed, but the decrease is not critical.

As can be seen in FIG. 6, the ignition circuit 120 delivers an ignition pulse that is within specification when the capacitive load is 150 pF. The peak voltage is 3.26 kV and the 2.7 kV width is about 1.0 $\mu$s. Some decrease in the average voltage is observed, but the decrease is not critical.

In summary , FIGS. 4 through 6 illustrate that the ignition circuit 120 generates ignition pulses that are within specification for a wide range of expected load capacitance. This performance is achieved while providing a significant inductance at full load current to aid in ripple current reduction.

Figure 7:
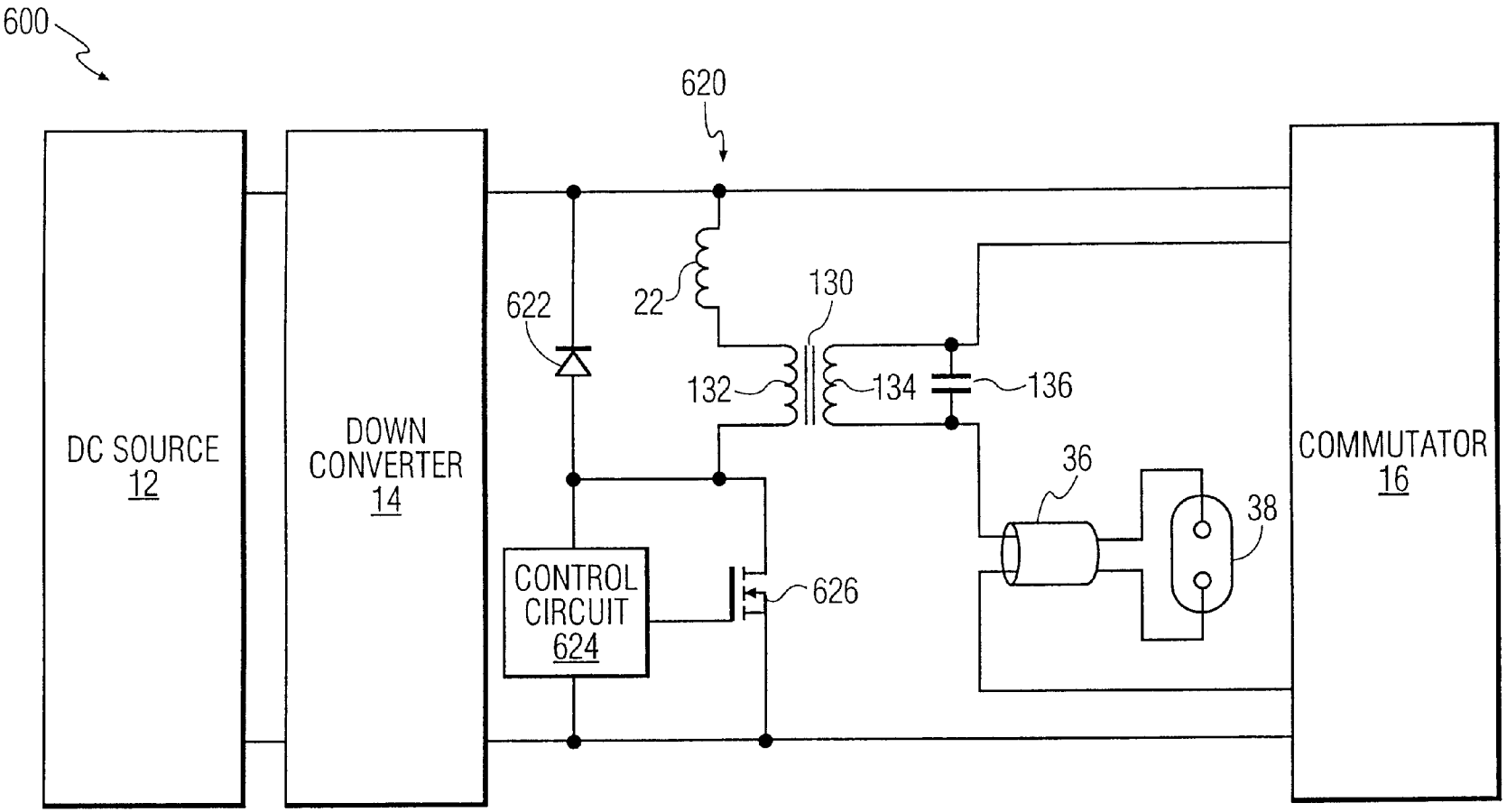
FIG. 7 is a schematic circuit diagram of another improved ignition circuit in accordance with the present invention, which is incorporated into the ballast of FIG. 1 to improve the overall performance thereof.

A ballast 600 having an improved HID ignition circuit 620 is shown in FIG. 7. The various components and circuits of the ballast 600 are similar to those of the ballast 100, except that the SIDACs 24 and 26, the resistor 28, and the capacitor 29 in ignition circuit 120 have been replaced with a MOSFET power switch. Specifically, the ignition circuit 620 includes a MOSFET 626 in series with the primary winding 132 of the gapped transformer 130 and a control circuit 624 coupled to the gate of the MOSFET 624. The control circuit 624 is designed in a manner well known in the art to control pulse generation by switching the MOSFET 626 ON or OFF in accordance with the voltage across it. A diode 622 protects the MOSFET 626 by limiting overvoltage during turn off.

The description of the invention and its applications as set forth herein is illustrative and is not intended to limit the scope of the invention as set forth in the following claims. Variations and modifications of the embodiments disclosed herein are possible, and practical alternatives to and equivalents of the various elements of the embodiments are known to those of ordinary skill in the art. These and other variations and modifications of the embodiments disclosed herein may be made without departing from the scope and spirit of the invention as set forth in the following claims.

What is claimed is:

1. An ignition circuit for igniting a high intensity discharge lamp having a predetermined ignition pulse specification and a predetermined maximum operating load current drain specification, comprising:

a transformer having a primary winding and at least one secondary winding, the transformer being rated to avoid saturating with the maximum operating load current flowing through the secondary winding thereof;

a first capacitor coupled in parallel with the secondary winding of the transformer;

first and second lamp connection nodes coupled in series with the secondary winding of the transformer; and a power switch coupled in series with the primary winding of the transformer.

2. An ignition circuit as in claim 1 wherein the first capacitor has a capacitance and the secondary winding of the transformer an inductance, the capacitance of the first capacitor and the inductance of the secondary winding of the transformer being selected to meet the ignition pulse specification of the lamp during ignition thereof.

3. An ignition circuit as in claim 1 further comprising a cable coupled to the first and second lamp connection nodes, the cable having a capacitance and the first capacitor having a capacitance greater than the capacitance of the cable.

4. An ignition circuit as in claim 1 wherein the transformer is a gapped transformer.

5. An ignition circuit as in claim 4 wherein the first capacitor has a capacitance and the secondary winding of the transformer inductance, the capacitance of the first capacitor and the inductance of the secondary winding of the transformer being selected to meet the ignition pulse specification of the lamp during ignition thereof.

6. An ignition circuit as in claim 5 further comprising a cable coupled to the first and second lamp connection nodes, the cable having a capacitance and the capacitance of the first capacitor being greater than the capacitance of the cable.

7. An ignition circuit as in claim 4 further comprising an inductor coupled in series with the primary winding of the gapped transformer.

8. An ignition circuit as in claim 1 wherein the power switch comprises a voltage-dependent breakover element.

9. An ignition circuit as in claim 8 further comprising a second capacitor and a resistor coupled in parallel with the second capacitor, the parallel coupled resistor and second capacitor being coupled in series with the voltage-dependent breakover element.

10. An ignition circuit as in claim 1 wherein the power switch comprises an IGBT.

11. An ignition circuit as in claim 1 wherein the power switch comprises a MOSFET.

12. An ignition circuit as claimed in claim 1 further comprising a source of low frequency square wave voltage coupled to the primary winding of the transformer, and a source of alternating operating voltage for the discharge lamp coupled to the secondary winding of the transformer, the transformer parameters being chosen so that the transformer does not saturate at the full load operating current of the discharge lamp.

13. An ignition circuit as claimed in claim 1 wherein the capacitance of the first capacitor is selected so as to adjust the resonant frequency of the secondary circuit of the transformer so as to shape the ignition pulse generated by the transformer in a manner which meets the predetermined ignition pulse specification and so as to stabilize the total capacitance seen by the ignition circuit.

14. An ignition circuit as claimed in claim 1 wherein the capacitance of the first capacitor is greater than all other capacitance in the load circuit of the secondary winding.

15. An electronic ballast for igniting and operating a high intensity discharge lamp, comprising:

a DC power supply having output nodes;

a commutator having input nodes coupled to the output nodes of the DC power supply and having output nodes;

a gapped transformer having a primary winding and at least one secondary winding;

an ignition secondary circuit comprising the secondary winding of the gapped transformer, a first capacitor coupled in parallel with the secondary winding of the gapped transformer, and first and second lamp connection nodes coupled in series with the secondary winding of the gapped transformer between the output nodes of the commutator; and an ignition primary circuit comprising an inductor, the primary of the gapped transformer, a voltage-dependent breakover element; and a second capacitor coupled in series between the output nodes of the DC power supply, the ignition primary circuit further having a resistor coupled in parallel with the second capacitor.

16. A ballast as in claim 15 wherein the voltage-dependent breakover element comprises a pair of serially coupled SIDACs.

17. A method of igniting a high intensity discharge lamp having a predetermined ignition pulse specification and a predetermined maximum operating load current, comprising:

applying a voltage pulse to a primary winding of a transformer to produce a high voltage pulse on a secondary winding thereof;

shaping the high voltage pulse with a first capacitor connected in parallel with the secondary winding of the transformer to create an ignition pulse in compliance with the predetermined ignition pulse specification of the high intensity discharge lamp;

applying the ignition pulse to the high intensity discharge lamp to start the lamp; and furnishing the predetermined maximum operating load current to the lamp through the secondary winding of the transformer without causing the transformer to saturate.

18. A method as in claim 17 wherein the voltage pulse applying step comprises:

charging a second capacitor through a power switch in series with the primary winding of the transformer during a first time when the power switch is conductive; and discharging the second capacitor through a resistor during a second time when the power switch is non-conductive.

* * * * *